US005443226A

United States Patent [19]

Alexander, III et al.

[11] Patent Number: 5,443,226

[45] Date of Patent: * Aug. 22, 1995

[54] CENTER WIND TAKEUP DRIVE AND METHOD

[75] Inventors: William J. Alexander, III, Mauldin; Shala W. Summey, III, Greenville, both of S.C.

[73] Assignee: Alexander Machinery, Inc., Mauldin, S.C.

[ * ] Notice: The portion of the term of this patent subsequent to Jul. 25, 2012 has been disclaimed.

[21] Appl. No.: 126,401

[22] Filed: Sep. 27, 1993

[51] Int. Cl.[6] ..... B65H 18/10

[52] U.S. Cl. ..... 242/533.8

[58] Field of Search ..... 242/67.1 R, 67.2, 67.3 R, 242/533.8

[56] References Cited

U.S. PATENT DOCUMENTS

| | | | |
|---|---|---|---|
| 2,206,580 | 7/1940 | Potdevin et al. | 242/67.1 R |
| 2,569,589 | 10/1951 | Trissell | 242/67.1 R |
| 3,813,053 | 5/1974 | Butler, Jr. et al. | 242/67.1 R X |
| 4,139,166 | 2/1979 | Powell et al. | 242/66 |
| 5,056,730 | 10/1991 | Bückle | 242/67.1 R X |
| 5,184,787 | 2/1993 | Holzinger et al. | 242/65 |
| 5,299,753 | 4/1994 | Alexander, III | 242/67.1 R X |

*Primary Examiner*—John P. Darling
*Attorney, Agent, or Firm*—Ralph Bailey

[57] ABSTRACT

A drive for a movable center wind takeup for web material has an upright support frame (A) which carries a motor driven power takeoff (B) which is drivingly engageable with the movable takeup. An articulated arm (C) is carried by the upright support and is extensible to achieve alignment between the power takeoff (B) for driving the takeup and a vertically adjustable device (D) including a lever arm for effecting vertical adjustment between the power takeoff (B) and the takeup.

7 Claims, 3 Drawing Sheets

CENTER WIND TAKEUP DRIVE AND METHOD

BACKGROUND OF THE INVENTION

This invention relates to center wind takeups for cloth and other web material and more especially to a versatile drive therefor which facilitates movement of an A-Frame or T-Frame takeup and the like for doffing and subsequent coupling of the drive with the takeup to begin a new winding operation.

Center wind takeups are generally movable for purposes of doffing and are often driven by center assist drives which include a motor mounted on the floor driving the takeup roll through a universal joint. The drive must be disconnected when the takeup is moved for doffing and connected when the takeup has been returned following a doffing operation to begin a new winding cycle. Center wind takeups or A-frames are sometimes driven by motors carried by the frame. Another type of A-frame drive is illustrated in U.S. Pat. No. 4,139,166 wherein a surface drive is provided for the center wind roll of a batcher. The surface drive includes a pivoted arm carrying a pair of driven rolls, one of which is driven faster than the other to ensure a tightly wound cloth roll.

All of the various driving arrangements discussed above have disadvantages in that they are relatively complex or they require movement of the drive motor together with the A-frame during doffing. In addition, the drive mechanisms described above, except those carried by the A-frame, are relatively difficult to set in motion after a doffing operation because of the difficulty in achieving proper alignment between the drive mechanism and the takeup roll.

SUMMARY OF THE INVENTION

Accordingly, it is an important object of the invention to provide a drive for a movable takeup which includes an articulated arm for carrying a motor for facilitating horizontal adjustment for making connection between the drive and the center wind roll of movable takeup after doffing for initiating a new winding operation.

Another object of the invention is to provide a drive for a movable takeup which is positionable adjacent a source of web material such as a weaving machine and the like which has an upright support frame carrying an articulated extensible arm with a lever operated cam mechanism for effecting vertical adjustment between a power takeoff carried by the arm and a drive coupling carried by a driven shaft of the movable takeup for effecting a center wind drive. The articulated arm has a plurality of links pivoted at each end on a vertical pin. The lever operated cam mechanism constitutes a manually operated jack.

Another important object of the invention is to provide a method for disconnecting and thereafter coupling a drive motor to the center wind shaft of an A-frame and the like by providing an upright support which is positionable adjacent a source of web material and extensibly positioning a motor upon an articulated arm for carrying the motor at the free end of the arm readily positioning same for horizontal adjustment and providing a cam operated jacking mechanism for effecting vertical adjustment between the motor and a free end of the articulated arm.

Still another important object of the invention is to provide a drive mechanism suitable for use on either a single or double roll takeup.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a side elevational view, partially in section, at an enlarged scale taken on the line 3—3 in FIG. 2 further illustrating the takeup drive.

DESCRIPTION OF A PREFERRED EMBODIMENT

The drawings illustrate a drive for a movable takeup for web material having a horizontal shaft with a drive coupling adjacent one end. An upright support frame A is positionable adjacent a source of web material. A motor driven power takeoff B is engageable with the coupling. An articulated arm C is carried by the upright support frame extensible for horizontal alignment carrying the motor driven power takeoff for engagement with the coupling. Vertically adjustable means D carry the power takeoff on the articulated arm for vertical alignment with the coupling. Thus, the takeup may be movably positioned in alignment with the source of web material, and the power takeoff mounted on the articulated arm for horizontal and vertical alignment with the drive coupling facilitating the use of a disengageable drive for a movable web takeup.

Figure 1:
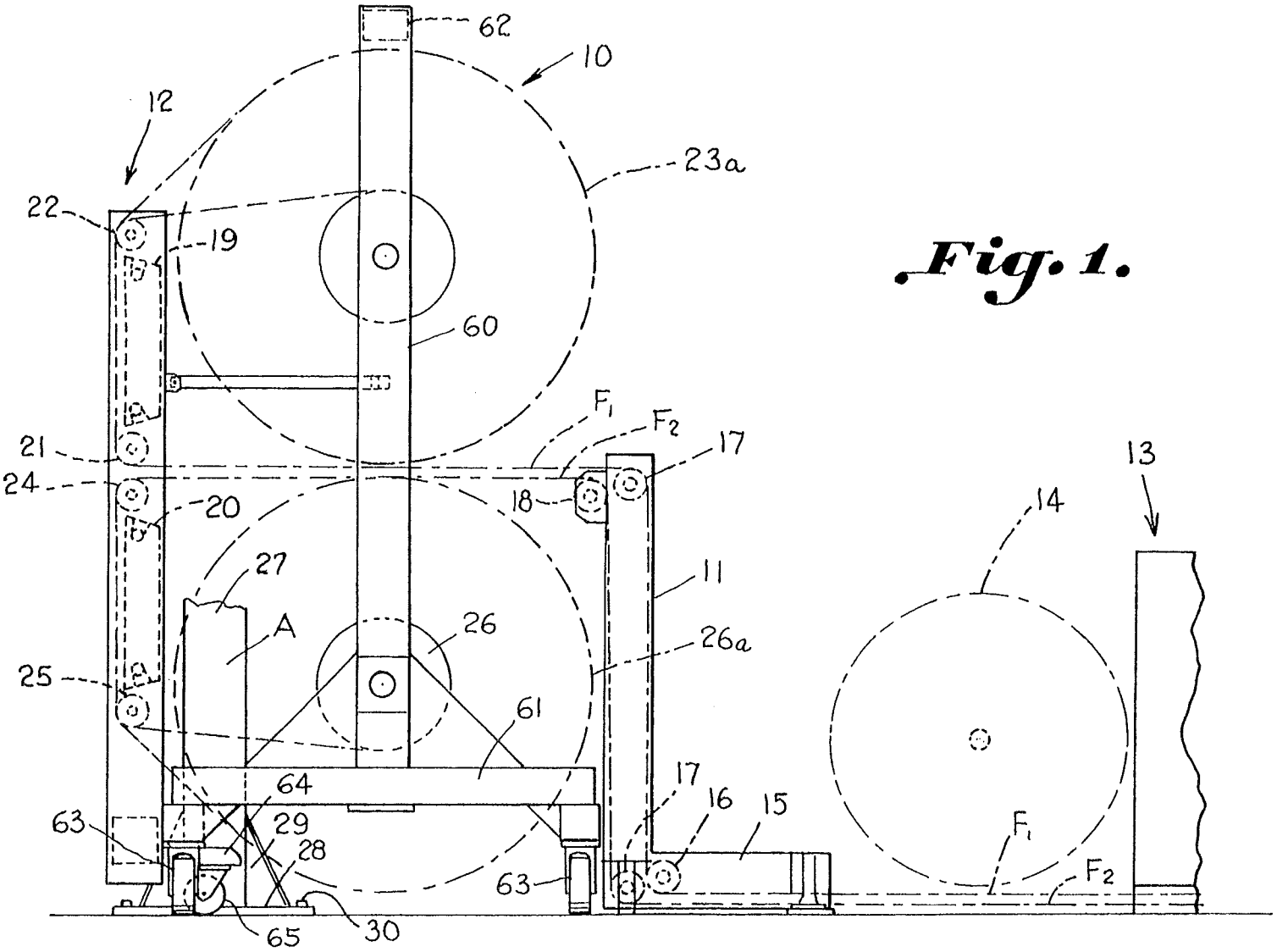
FIG. 1 is a side elevational view illustrating a movable center wind takeup carried on a delivery side of a work platform positioned above a run of cloth passing from a weaving machine to a cloth inspection device positioned on an opposite side of the movable takeup and thence returning the cloth to be wound on the movable takeup together with an upright support on the far side which carries and forms a part of the takeup drive apparatus constructed in accordance with the present invention.
Figure 2:
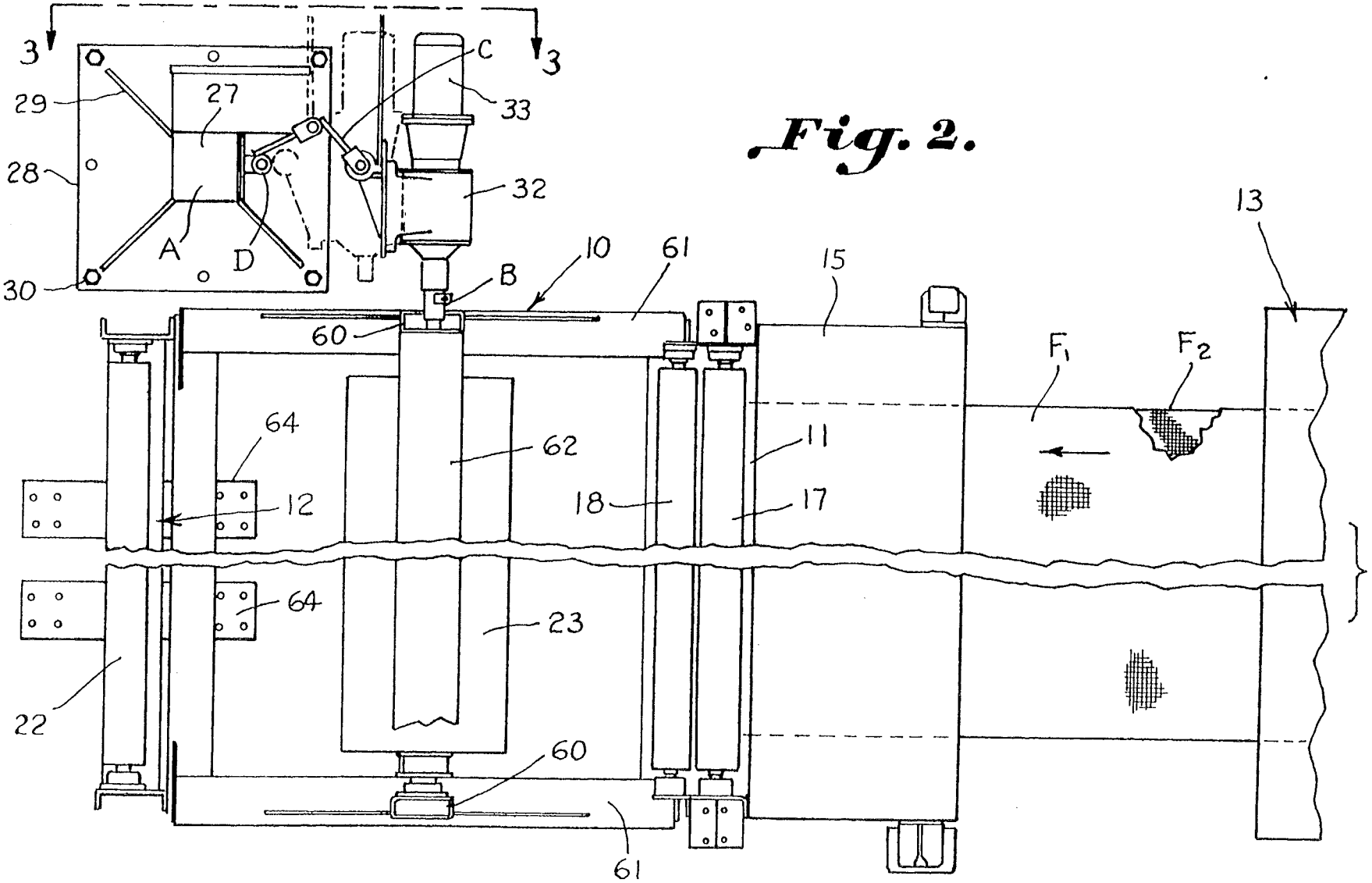
FIG. 2 is a top plan view illustrating the apparatus shown in FIG. 1 with details of the takeup drive mechanism constructed in accordance with the present invention carried by the upright support frame on an articulated arm and in driving relation to a center wound roll.

Referring especially to FIGS. 1 and 2, a movable center wind takeup is broadly designated at 10. The takeup is positioned between a vertical guide 11 which carries two runs of fabric, $F_1$ and $F_2$, for delivery to a cloth inspection apparatus broadly designated at 12 on an opposite side of the movable takeup.

The runs of fabric, $F_1$ and $F_2$, are delivered beneath a weaving machine broadly designated at 13. The delivery of the fabric is from the rear of the weaving machine. A warp beam is shown schematically in broken lines in FIG. 1 as at 14. The runs of cloth $F_1$ and $F_2$, pass beneath a worker's platform 15 and thence over guide rolls 16 and 17 respectively and thence upwardly over the rolls 17 and 18 respectively carried adjacent an upper end of the guide 11 for passage in a horizontal run about an upper light box 19 and a lower light box 20 respectively as is best shown in FIG. 1. The cloth $F_1$ passes about rolls 21 and 22 for delivery to the upper center wound takeup roll 23. The lower run of cloth $F_2$ passes over rolls 24 and 25 for delivery to the lower center wound roll 26. The respective center wind rolls 23 and 26 build rolls of cloth or other web materials as illustrated in broken lines at 23*a* and 26*a*.

The takeup drive includes an upright support frame A as illustrated in FIGS. 1, 2 and 3 which includes a vertical standard 27 and a base plate 28 which is connected thereto by suitable reinforcing members 29 and bolted to the floor as at 30.

Figures 4, 5:
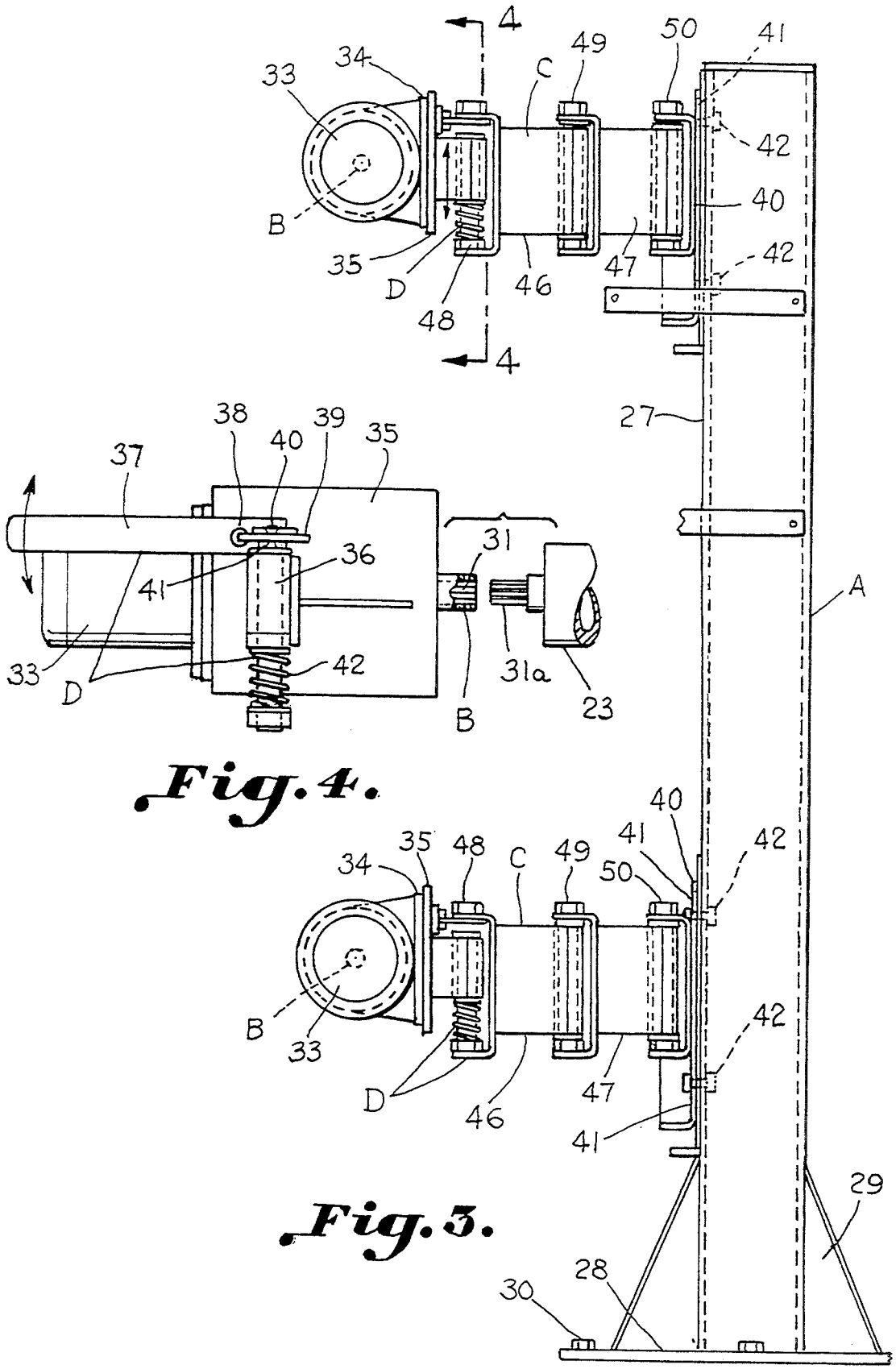
FIG. 4 is an enlarged elevational view taken on the line 4—4 in FIG. 3 illustrating the internal splines of a power takeoff, mounted for horizontal and vertical adjustment on the articulated arm, about to be connected to a splined drive coupling of a takeup roll.

Referring more particularly to FIGS. 2, 3 and 4, a motor driven power takeoff B is illustrated as including an internal spline 31 (FIG. 4) carried adjacent a free end of an articulated arm C. The motor driven power takeoff B which includes the internal splines 31 is carried by a power transmission mechanism 32 and is driven by the motor 33. The internal splines 31 are adapted to engage the external splines 31*a* of the drive coupling carried by each of the respective center wind rolls 23 and 26. The motor 33 is carried by the mounting bracket 34 upon a mounting plate 35 which is carried adjacent the free end of the articulated extensible arm C. Referring to FIG. 4, the mounting plate 35 may be raised and lowered upon a guide bracket 36. Vertically adjustable means D includes a lever arm 37 which is pivoted at 38 for actuating a cam 39 mounted between the pins 40 and 41. A coiled spring is illustrated at 42 for balancing the weight of the motor in such a way in that the spring 42 need not be compressed or extended by any great amount to raise and lower the motor 33 and the power takeoff B carried thereby in relation to the center wind roll illustrated as being the upper center wind roll 23 in FIG. 4. It should be noted that identical apparatus including the extensible arm C is carried by the upright support frame of the drive for accommodating either or both of the center wind rolls 22 and 26 respectively.

The articulated arms C are carried for vertical adjustment by the upright support frame A as by mounting plates 40 having vertical slots 41 for adjustable securement by bolts 42 to the vertical standard 27 forming the upright support frame A. The articulated arm C include links 45, 46 and 47 for pivotal movement on vertical axes as at 48, 49 and 50.

Referring more particularly to FIG. 1, it will be noted that the vertical standards 60 are positioned at the bottom upon a platform 61 and bridged at the top by a horizontal member 62. The platform 61 is carried by lockable casters 63. The cloth inspection apparatus is mounted upon platforms 64 upon lockable casters 65.

It is thus seen that a drive for a movable takeup has been provided wherein the upright support frame A may be bolted to the floor adjacent a source of web material such as a weaving machine. The power takeoff B may be readily adjustable in a horizontal plane relative to a drive coupling carried by a center wind takeup roll and the like. Vertical adjustment is provided through a cam and lever arrangement adjacent a free end of the articulated arms C. The motor is preferably carried adjacent the free end of the arm and horizontally disposed as illustrated but may be positioned in any other desired adjacent location and utilize a flexible drive or other means for driving the power takeoff B carried adjacent the ends of the extensible arms C. The drive of the present invention may be of either the single or double variety depending upon the number of takeup rolls on the A-frame to be accommodated.

While a preferred embodiment of the invention has been described using specific terms, such description is for illustrative purposes only, and it is to be understood that changes and variations may be made without departing from the spirit or scope of the following claims.

What is claimed is:

1. A drive for a movable takeup for web material having a horizontal shaft with a drive coupling adjacent one end comprising:

an upright support frame positionable adjacent a source of web material;

a motor driven power takeoff engageable with said coupling;

an articulated arm carried by said upright support frame extensible in relation thereto for horizontal movement in respect to said drive coupling carrying said motor driven power takeoff for horizontal alignment and for engagement with said coupling;

a mounting for said arm carried by said upright support frame including an upright pivotal member supporting said arm for said horizontal movement; and vertically adjustable means carrying said power takeoff on said articulated arm for vertical alignment with said coupling;

whereby said takeup may be movably positioned in alignment with said source of web material, and said power takeoff mounted on said articulated arm carried by said upright support frame for horizontal and vertical alignment facilitating the use of a disengageable drive for a movable web takeup.

2. The drive for a moveable takeup set forth in claim 1 including upper and lower motor driven power takeoffs carried by respective upper and lower articulated arms carrying vertically adjustable means for raising and lowering respective power takeoffs.

3. The drive for a moveable takeup set forth in claim 1 including a motor carried in horizontal alignment with said power takeoff adjacent a free end of said articulated arm.

4. The drive for a moveable takeup set forth in claim 3 wherein said articulated arm includes a plurality of links each pivoted on a hinge having a vertical axis.

5. The drive for a moveable takeup set forth in claim 4 wherein said vertically adjustable means includes an upright guide.

6. The drive for a moveable takeup set forth in claim 5 wherein said vertically adjustable means includes a lever operated cam, and a spring balancing the weight of said motor.

7. A method of driving a movable takeup for web material having a horizontal shaft with a drive coupling adjacent one end comprising the steps of:

positioning an upright support frame adjacent a source of web material;

providing a motor driven power takeoff engageable with said coupling;

supporting said motor driven power takeup on said upright support frame on an articulated arm carried by said upright support frame extensible in relation thereto for horizontal movement in respect to said drive coupling carrying said motor driven power takeoff for horizontal alignment and for engagement with said coupling;

moving said motor driven power takeoff horizontally in respect to said upright support frame, thus adjusting the horizontal alignment of said motor driven power takeoff for engagement with said coupling; and providing a mounting for said arm carried by said upright support frame including an upright pivotal member supporting said arm for said horizontal movement; and vertically moving said power takeoff for vertical alignment with said coupling;

whereby said takeup may be movably positioned in alignment with said source of web material, and said power takeoff carried on said upright support frame for horizontal and vertical alignment with said drive coupling facilitating the use of a disengageable drive for a movable web takeup.

* * * * *